United States Patent [19]

Kuno et al.

[11] Patent Number: 4,496,872

[45] Date of Patent: Jan. 29, 1985

[54] SEALED BEAM TYPE REFLECTIVE LAMP

[75] Inventors: Nobuyoshi Kuno, Yokohama; Kiyokazu Honda, Zushi, both of Japan

[73] Assignee: Tokyo Shibaura Denki Kabushiki Kaisha, Japan

[21] Appl. No.: 365,384

[22] Filed: Apr. 5, 1982

[30] Foreign Application Priority Data

Apr. 7, 1981 [JP] Japan ..... 56/51058

[51] Int. Cl.[3] ..... H01K 1/30

[52] U.S. Cl. ..... 313/113; 350/432; 362/340

[58] Field of Search ..... 313/113, 111, 25; 350/432; 362/340, 335, 268

[56] References Cited

U.S. PATENT DOCUMENTS

| | | | |
|---|---|---|---|
| 2,191,278 | 2/1940 | Johnson | 362/340 X |
| 2,831,394 | 4/1958 | Heenan et al. | 362/340 X |
| 3,392,277 | 7/1968 | Dawson | 362/340 X |
| 3,743,385 | 7/1973 | Schaefer | 350/432 |
| 4,039,885 | 8/1977 | van Boekhold et al. | 313/113 X |
| 4,152,756 | 5/1979 | Wrege et al. | 362/340 X |
| 4,158,222 | 6/1979 | Cook | 350/432 |

FOREIGN PATENT DOCUMENTS

| | | | |
|---|---|---|---|
| 147676 | 11/1979 | Japan | 313/111 |

OTHER PUBLICATIONS

Lamps and Lighting, S. T. Henderson & A. M. Marsden, Thorn Lighting Ltd., pp. 172–179, 488–491, 1972.

*Primary Examiner*—David K. Moore
*Assistant Examiner*—K. Wieder
*Attorney, Agent, or Firm*—Cushman, Darby & Cushman

[57] ABSTRACT

A sealed beam type reflective lamp has an envelope comprising a front lens and a reflector on the inner surface of which is formed a metal reflective film, and a tungsten coil filament arranged inside the front lens. The lamp has excellent converging effect and its light beam does not spread even if the filament is brought closer to the front lens. The front lens consists of a central circular lens element and a plurality of concentric ring-shaped prism elements. The inner surfaces of these prism elements define a stepped inner surface of the front lens. An angle formed by an inner surface of the prism lens element and the central axis of the lamp is greater than that of the prism lens element situated outward thereof. The step difference of the inner surfaces of the adjacent prism lens elements is 0.6 mm or less.

2 Claims, 4 Drawing Figures

SEALED BEAM TYPE REFLECTIVE LAMP

BACKGROUND OF THE INVENTION

The present invention relates to a sealed beam type reflective lamp and, more particularly, to an improvement in a front lens of an envelope of a sealed beam type reflective lamp having reflective lighting characteristics of spot lighting type.

A sealed beam type reflective lamp comprises a reflector on the inner surface of which is deposited a metal reflective film of aluminum or the like, a light source assembly having a tungsten coil filament arranged near the central axis of the reflector, and a front lens sealed to the opening of the reflector. Sealed beam type reflective lamps are classified into those of spot lighting type and those of flood lighting type according to the size of the illuminating area. With a sealed beam type reflective lamp of spot lighting type, a beam spread exhibiting a luminous intensity of $\frac{1}{2}$ the central luminous intensity is 15°. The deviation of the luminous intensity at the illuminating area is required to be small. As a typical example of such a lamp, a lamp of 100 V–100 W is known which has an envelope having a diameter of about 121 mm ($\frac{1}{8}''\times 38$).

In a conventional sealed beam type reflective lamp of spot lighting type, the inner surface of the front lens is stippled to disperse incident light. A front lens having such stipples has an unsatisfactory converging effect. In order to increase the central luminous intensity and to improve the converging effect, the tungsten coil filament is brought closer to the stippled front lens, the beam spread exhibiting a luminous intensity of $\frac{1}{2}$ the central luminous intensity exceeds 15°, the central luminous intensity is lowered, and the deviation of the luminous intensity at the illuminating area increases. These characteristics are not preferable for a lamp of spot lighting type.

SUMMARY OF THE INVENTION

It is an object of the present invention to provide a sealed beam type reflective lamp which has excellent converging effect, a high central luminous intensity, a moderate beam spread when a filament is brought closer to a front lens, and a small deviation of the luminous intensity in the illuminating area.

In order to achieve this object, there is provided according to the present invention a sealed beam type reflective lamp having an envelope comprising a front lens and a reflector on an inner surface of which is formed a metal reflective film, and a tungsten coil filament arranged inside said envelope, characterized in that said front lens consists of a central circular lens element and a plurality of concentric ring-shaped prism lens elements, inner surfaces of said prism lens elements define a stepped inner surface of said front lens, angles formed by said inner surfaces of said prism lens elements with a central axis of said lamp gradually increase toward a center of said front lens, and a step difference of said inner surfaces between adjacent ones of said prism lens elements is not greater than 0.6 mm.

DETAILED DESCRIPTION OF THE PREFERRED EMBODIMENTS

The preferred embodiment of the present invention will now be described with reference to the accompanying drawings.

Figure 1:
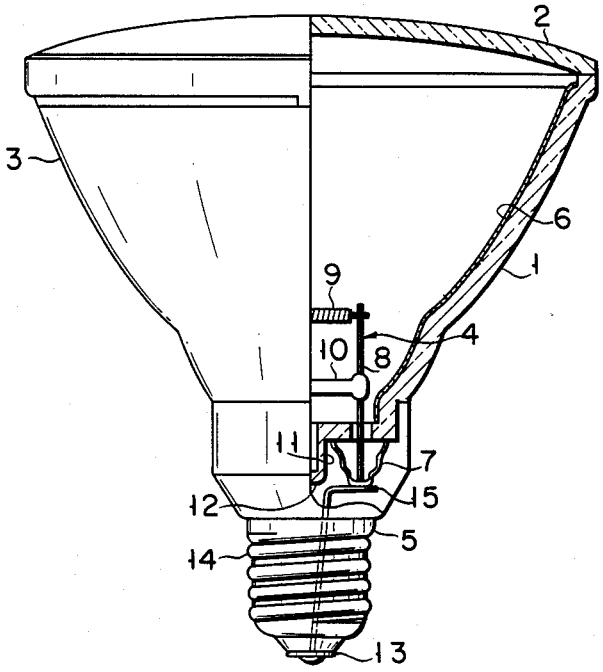
FIG. 1 is a partially cutaway, sectional view of a sealed beam type reflective lamp according to an embodiment of the present invention.

FIG. 1 is a partially cutaway, sectional view of a sealed beam type reflective lamp (100 V–100 W, PAR 38) according to an embodiment of the present invention. This lamp has an envelope 3 consisting of a reflector 1 and a front lens 2 covering the opening of the reflector, a light source assembly 4 arranged inside the envelope 3, and a metal base 5 mounted on the end of the envelope 3.

A metal reflective film 6 of deposited aluminum or the like is formed on the inner surface of the reflector 1. A pair of ferrules 7 are mounted on the bottom of the reflector 1. One ends of a pair of lead wires 8 extending through the bottom of the reflector 1 are respectively mounted on these ferrules 7 by brazing. The other ends of the lead wires 8 are connected to ends of a tungsten coil filament 9. The lead wires 8 are supported by a support 10. The lead wires 8, the tungsten coil filament 9, and the support 10 constitute the light source assembly 4. On the opening end of the reflector 1 is mounted the periphery of the front lens having a plurality of concentric, stepped prism lens elements.

The interior of the envelope 3 consisting of the reflector 1 and the front lens 2 is evacuated through an evacuating tube 11 formed at the bottom of the envelope 3. Thereafter, an inert gas such as argon is sealed in the envelope 3. The end of the evacuating tube 11 is sealed to provide a sealed end 12. The metal base 5 is mounted around the bottom of the envelope 3. The metal base 5 consists of an eyelet 13 and a shell 14. Outer wires 15 connected to the ferrules 7 are respectively brazed to the eyelet 13 and the shell 14. The eyelet 13 and the shell 14 constitute outer terminals of the lamp.

Figure 2:
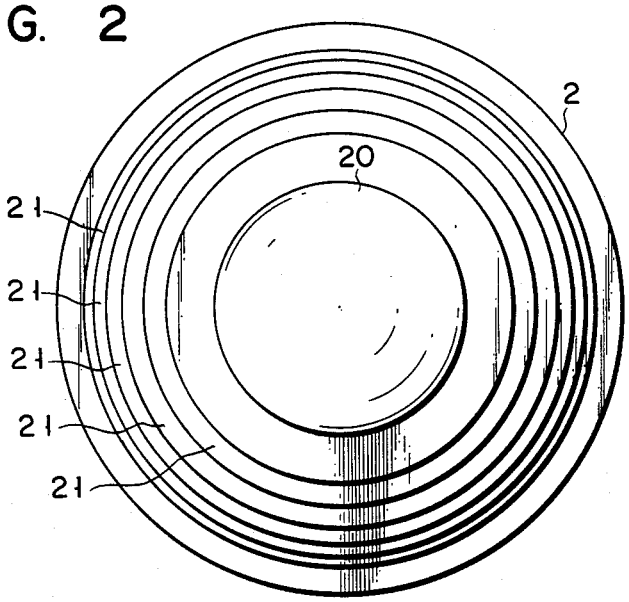
FIG. 2 is a plan view of a front lens of the lamp shown in FIG. 1 when viewed from the interior of the lamp.

FIG. 2 shows the inner surface of the front lens 2. The front lens 2 consists of a central circular lens element 20, and a plurality of concentric ring-shaped prism lens elements 21 which surround the lens element 20 and which have stepped inner surfaces.

Figure 3:
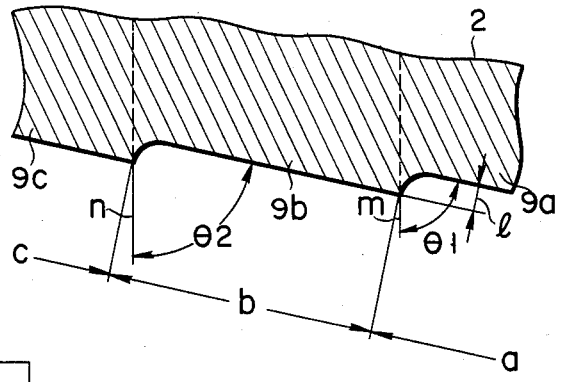
FIG. 3 is a partial, enlarged, sectional view of the front lens shown in FIG. 2.

FIG. 3 is a partial, enlarged, sectional view of the front lens shown in FIG. 2, and shows prism lens elements 9*a*, 9*b*, and 9*c*. Angles $\theta 1$, $\theta 2$, and so on formed by the inner surfaces of the individual prism lens elements and the lamp axis gradually increase toward the center of the front lens 2. Since the prism lens elements 9*a*, 9*b* and 9*c* are farther from the center of the front lens in the order named, $\theta 2 > \theta 1$. Lines m and n are both lines parallel to the lamp axis. The front lens 2 is divided into a plurality of ring-shaped prism lens elements by these lines m, n and so on (to be more strict, cylinders defined by traces of lines m, n and so on). Radial widths a, b and c of the prism lens elements 9*a*, 9*b* and 9*c* preferably increase toward the center of the front lens 2. An example of the specifications of the front lens having a 123 mm diameter used for the lamp shown in FIG. 1 is shown in Table below:

TABLE

| Prism lens element No. | Distance from periphery of front lens (mm) | Width B (mm) | Angle $\theta$ between inner surface of prism lens element and lamp axis |
|---|---|---|---|
| 1 | 9–11 | 2 | 73 |
| 2 | –13.5 | 2.5 | 74.5 |
| 3 | 13.5–16.5 | 3 | 76 |
| 4 | 16.5–20.5 | 4 | 77.5 |
| 5 | 20.5–25.5 | 5 | 79 |
| 6 | 25.5–35.5 | 10 | 82 |

The step difference l of the inner surfaces of the adjacent prism lens elements must be 0.6 mm or less. When the step difference l exceeds 0.6 mm, the flowability of glass as the raw material is impaired during pressing in the molding process of the front lens. When this occurs, it is difficult to produce prism lens elements of desired shapes. The radial width of each prism lens element is preferably about 2 mm or more. When the radial width of the prism lens element is less than 2 mm, the central luminous intensity of the lamp is lowered which is not preferable. The inner surface of the prism lens element of the present invention may be flat or may have stipples.

Figure 4:
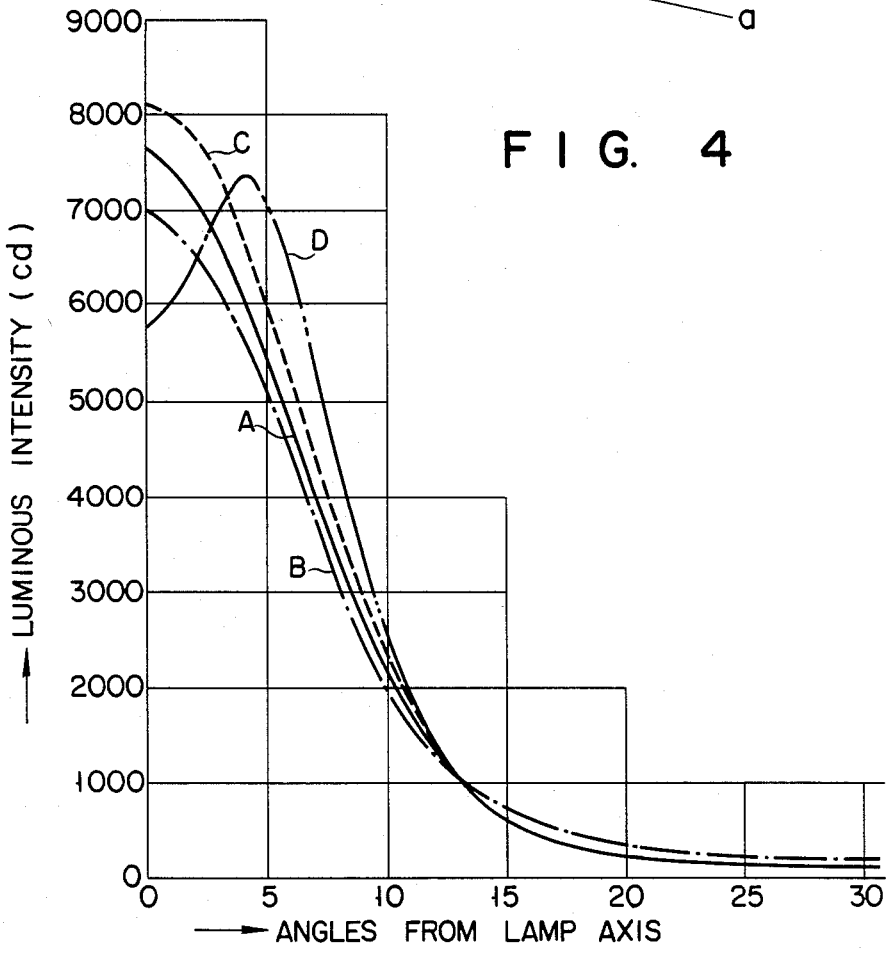
FIG. 4 is a graph showing luminous intensity distribution curves of sealed beam type reflective lamps of prior art and of the present invention.

For the purpose of showing the excellent characteristics of a sealed beam type reflective lamp of the present invention, the luminous intensity of the sealed beam type reflective lamp of the prior art and of the present invention was measured at various angles from the lamp axis. FIG. 4 shows the luminous intensity distribution curves obtained. The lamp of the present invention was the lamp shown in FIG. 1 (100 V–100 W, PAR 38) which had the front lens having the specifications shown in Table. The prior art lamp was substantially the same as that shown in FIG. 1 except that the inner surface of the front lens had only stipples and do not form stepwise. The inner diameter of the effective reflective surface of the reflector was 111.6 mm for each case. The luminous intensity was measured at a distance of 3 m from the lamp while rotating the lamp about the axis thereof.

In FIG. 4, curves A and B represent the luminous intensity distributions of the lamp of the present invention and the prior art lamp, respectively. When curves A and B are compared, the central luminous intensity of the prior art lamp is seen to be 7,000 cd (candela) whereas the central luminous intensity of the lamp of the present invention (wherein the angles formed by the inner surfaces of the individual prism lens elements of the front lens and the lamp axis gradually increase toward the center of the front lens) is seen to be 7,630 cd. It is seen from this comparison that the lamp of the present invention is improved over the prior art lamp. Curves C and D respectively show luminous intensity distributions when the positions of the tungsten filaments of the lamp of the present invention and the prior art were brought closer to the front lens by about 2 mm. From the comparison of curves C and D, it is seen that the central luminous intensity of the lamp of the present invention is improved by about 16% to 8,100 cd and no irregularity of the luminous intensity is observed when the filament is brought close to the front lens. In contrast to this, with the prior art lamp, the central luminous intensity decreases to 5,850 cd, and the point of maximum luminous intensity shifts to a position about 9° from the lamp axis. From results presented above, it may be concluded that the light beam does not spread with the lamp of the present invention even if the filament is brought close to the front lens in order to increase the central laminous intensity.

In summary, with a sealed beam type reflective lamp of the present invention, the converging effects are better and the central luminous intensity is higher as compared to these of the prior art lamp which has a front lens the inner surface of which is merely stippled. Further, even when the filament is brought closer to the front lens for the purpose of increasing the central luminous intensity, the light beam does not spread, and the deviation of the luminous intensity at the illuminating area is small. The lamp of the present invention is thus capable of excellent spot lighting.

We claim:

1. A spot-lighting sealed beam type reflective lamp having an envelope comprising a front lens and a reflector on an inner surface of which is formed a metal reflective film, and a tungsten coil filament arranged inside said envelope, wherein said front lens consists of a central circular lens element and a plurality of concentric ring-shaped prism lens elements, inner surfaces of said prism lens elements defining a stepped inner surface of said front lens, and wherein an angle formed by a central axis of said lamp and an inner surface of said prism lens element, which is substantially in the radial direction of said lens, is greater than that of the next prism lens elements situated outwardly thereof, a step difference of said inner surfaces between adjacent ones of said prism lens elements being not greater than 0.6 mm and radial widths of said prism lens elements increasing toward the central circular lens element.

2. A lamp according to claim 1, wherein the radial widths of said prism lens elements are 2 mm or more.

* * * * *